United States Patent [19]

Viehrig et al.

[11] Patent Number: 4,638,936

[45] Date of Patent: Jan. 27, 1987

[54] APPARATUS FOR TREATMENT OF WEBS OF PHOTOGRAPHIC MATERIAL

[75] Inventors: Wolfgang Viehrig; Karl-Heinz Wagner, both of Munich; Erwin Laar, Valley, all of Fed. Rep. of Germany

[73] Assignee: AGFA-Gevaert Aktiengesellschaft, Leverkusen, Fed. Rep. of Germany

[21] Appl. No.: 618,965

[22] Filed: Jun. 11, 1984

[30] Foreign Application Priority Data

Jun. 10, 1983 [DE] Fed. Rep. of Germany ..... 3321048

[51] Int. Cl.[4] ..... B65H 20/02; B65H 23/14

[52] U.S. Cl. ..... 226/191; 226/194; 226/195

[58] Field of Search ..... 226/191, 195, 194; 242/75.2, 156, 156.2, 99; 188/64, 65.1

[56] References Cited

U.S. PATENT DOCUMENTS

| | | | |
|---|---|---|---|
| 486,174 | 11/1892 | Allis | 242/156 X |
| 1,189,611 | 7/1916 | Morse | 226/195 X |
| 2,166,243 | 7/1939 | Elvin | 242/156 X |
| 2,726,828 | 12/1955 | Pashkow | 242/156 |
| 3,197,153 | 7/1965 | Davidson | 242/156.2 X |
| 3,369,765 | 2/1968 | Jensen | 226/191 X |
| 3,561,660 | 2/1971 | Nicol et al. | 226/194 X |
| 3,703,263 | 11/1972 | Hunter | 242/156 X |
| 3,746,142 | 7/1973 | Hepp et al. | 226/195 X |
| 4,134,663 | 1/1979 | Laar et al. | 354/298 |

FOREIGN PATENT DOCUMENTS 2603659 2/1981 Fed. Rep. of Germany .

*Primary Examiner*—Harvey C. Hornsby
*Assistant Examiner*—Scott J. Haugland
*Attorney, Agent, or Firm*—Peter K. Kontler

[57] ABSTRACT

A web of photographic paper is trained over several rollers so that it can be advanced along a meandering path through successive chambers in a developing machine. At least one of the rollers is mounted on a driven shaft with the interposition of a coupling which engages the shaft with the roller when the tension of the running web which is trained over such roller exceeds a certain value. The roller is normally held against rotation under the action of the web and/or under the action of the bearing which is rotatable on the shaft and yieldably maintains the roller in a position of coaxiality with the shaft. A braking device for holding the roller against rotation has a first plastic ring which is rotatably mounted on the shaft and is connected to or made integral with the bearing for the roller, and a second plastic ring which surrounds and is in frictional engagement with the first ring. The second ring is held against rotation with the first ring by a partition or by another stationary part of the machine.

19 Claims, 4 Drawing Figures

APPARATUS FOR TREATMENT OF WEBS OF PHOTOGRAPHIC MATERIAL

BACKGROUND OF THE INVENTION

The present invention relates to apparatus for wet treatment of photographic films, webs of photographic paper or the like.

Commonly owned German Pat. No. 26 03 659 discloses an apparatus wherein the running web is trained over several rollers of which only one is actually shown. The illustrated roller is rotatably mounted on a driven shaft in such a way that it can move radially of the shaft when the tension of the running web (which is trained over the peripheral surface of the roller) reaches a preselected value. This causes the roller to engage a coupling which then transmits torque from the shaft to the roller so as to prevent extensive acceleration of the roller under the action of the rapidly advancing web, i.e., the roller can continue to brake the web even if the coupling is engaged. In order to normally hold the roller against rotation under the action of the running web, the apparatus of the German patent employs a leaf spring engaging the peripheral surface of the roller with a force which suffices to overcome friction between the bearing for the roller and the shaft. Thus, frictional engagement between the peripheral surface of the roller and the leaf spring must be sufficiently pronounced to invariably ensure that the shaft cannot rotate the roller by way of the bearing (when the coupling is disengaged) and that the running web is also incapable of rotating the roller, i.e., that the web is braked because it must slip relative to the peripheral surface of the roller. The leaf spring is mounted on a partition of the vessel for one or more treating liquid media through which the web is caused to advance, preferably by being mounted on rollers which define therefor a meandering path. Reference may be had, for example, to commonly owned U.S. Pat. No. 4,134,663 granted Jan. 16, 1979 to Erwin Laar et al. The provision of a meandering path for the running web normally entails the placing of a roller into the deepmost portion of a supply of liquid and two rollers above the upper level of such supply. Of course, if the web is to remain in longer-lasting contact with a particular liquid medium, the respective vessel (or the respective compartment of the vessel) can contain several rollers which alternate with rollers at a level above the liquid bath.

The main purpose of the leaf spring which is disclosed in the aforementioned German patent is to ensure that the roller cannot be set in rotary motion due to friction which prevails between one or more bearings for the roller and the peripheral surface of the driven shaft, and especially that the roller cannot rotate at a peripheral speed which is higher than the speed at which the running web is pulled or otherwise moved along its path. As a rule, torque which is transmitted in the absence of the leaf spring is not very pronounced but the speed of the running web can be quite high so that, in the absence of braking action upon the roller, the trailing portion of the running web (such trailing portion can be several meters long) is not subjected to requisite tension; on the contrary, the rollers in the developing machine advance the trailing portion of the web at a progressively increasing speed so that the trailing portion is not guided with a requisite degree of accuracy. In fact, the acceleration of several loops of the running web at the trailing end thereof can be so pronounced that the web can be caught below the advancing band (which pulls the web through the developing machine) or can cause other types of disturbances. The leaf spring which brakes the roller in the apparatus of the aforementioned German patent becomes ineffective when the coupling between the roller and the driven shaft is engaged but such spring brakes the roller under all other circumstances. This ensures that the trailing portion of a long or very long web is properly guided and adequately braked irrespective of the speed of the web.

The just discussed leaf spring operates quite satisfactorily insofar as its braking action is concerned. However, such leaf spring also exhibits certain drawbacks. First of all, the spring must be made of a high quality steel or an equivalent expensive alloy which contributes significantly to the cost of the apparatus, especially if the apparatus employs a large number of rollers each of which is braked by a discrete leaf spring. Furthermore, the leaf spring causes pronounced wear upon the peripheral surface of the roller. Still further, the leaf spring does not allow for training of the running web over several coaxial rollers except if it is installed in such position that it engages the peripheral surface in a region which is invariably remote from the path of the running web.

OBJECTS AND SUMMARY OF THE INVENTION

An object of the invention is to provide a novel and improved apparatus wherein the roller or rollers for the running web are braked in such a way that the braking action does not affect their useful life.

Another object of the invention is to provide a novel and improved braking device for use in an apparatus of the above outlined character.

A further object of the invention is to provide a braking device which can be readily installed in such a way that it does not interfere with the travel of a running web along its prescribed path even if the web is to be trained over several coaxial rollers.

An additional object of the invention is to provide a braking device which is just as satisfactory as but less expensive than the conventional braking devices.

Another object of the invention is to provide a novel and improved method of braking rollers in apparatus for wet treatment of running webs of photographic paper or the like.

Still another object of the invention is to provide novel and improved bearing means for the roller or rollers in an apparatus of the above outlined character.

A further object of the invention is to provide a photographic developing machine which embodies the above outlined apparatus.

The invention resides in the provision of an apparatus for wet treatment of running webs of photographic paper or the like. The apparatus comprises a driven shaft, a hollow roller (e.g., an elongated sleeve) which normally coaxially surrounds the shaft and has a peripheral surface which is engageable by a running web so that the web tends to rotate the roller, bearing means for radially movably mounting the roller and being constructed and arranged to offer a predetermined resistance to radial movement of the roller relative to the shaft but to yield when the tension of the running web which contacts the peripheral surface of the roller reaches a preselected value, coupling means which is engageable to transmit torque from the shaft to the roller in response to radial movement of the roller, i.e., when the tension of the running web reaches the preselected value, and means for braking the roller in disengaged condition of the coupling means. The braking means includes a first braking member which is arranged to share the rotary movements of the roller with or relative to the shaft (e.g., the apparatus can comprise means for separably or integrally connecting the first braking member with the bearing means for the roller) and has an annular external surface which is coaxial with the shaft and is disposed radially inwardly of the peripheral surface of the roller (the diameter of the external surface is preferably a relatively small fraction of the diameter of the peripheral surface of the roller), a second braking member having an internal surface which is in frictional engagement with the external surface of the first braking member, and means for preventing rotation of the second braking member so that the first braking member rotates with the roller and relative to the second braking member in response to engagement of the coupling means. In accordance with a presently preferred embodiment of the apparatus, the bearing means for the roller is rotatably mounted on the shaft and the friction between such bearing means and the shaft is less pronounced than the friction between the first and second braking members so that the first braking member can normally hold the roller against rotation as long as the coupling means remains disengaged.

The second braking member can include a portion which extends radially outwardly from the first braking member and the rotation preventing means can comprise a stationary wall, a partition, a traverse or an analogous part which abuts against such portion of the second braking member.

The first braking member preferably comprises a synthetic plastic ring which is rotatably mounted on the shaft, and the means for connecting the ring to the roller can include at least one projection provided on the ring and a socket which is rotatable with the roller relative to the shaft and receives the projection. The socket can be provided on a discrete ring-shaped member which is rotatable with the bearing means (and the latter is rotatable with the roller). The socket is preferably disposed in the region of one end portion of the roller.

The second braking member can comprise a plastic split ring which surrounds the ring of the first braking member in prestressed condition so that its internal surface bears against the external surface of the ring which forms part of or constitutes the first braking member. The slot of the split ring is preferably adjacent to the aforementioned radially outwardly extending portion of the second braking member. Friction between the two rings is preferably many times the friction between the bearing means and the shaft.

The apparatus preferably further comprises means for holding the braking members against movement relative to each other in the axial direction of the shaft. To this end, the internal or the external surface can be provided with a circumferentially extending groove and the holding means can comprise a circumferentially complete or interrupted rib or an analogous projection which extends into the groove, preferably by snap action.

The aforementioned radially outwardly extending portion of the second braking member can comprise a tubular member which is integral with the split ring, and a post a first portion of which is removably received in the tubular member and a second portion of which extends outwardly beyond the tubular member to be engaged by the aforementioned stationary wall, partition, traverse or other suitable stop means. The first portion of the post is preferably elastic so that it can be held in the tubular member by snap action. For example, such first portion of the post can comprise several prongs.

The connecting means can comprise a projection which extends from the preferably ring-shaped first braking member in substantial parallelism with the axis of the shaft and a protuberance which can constitute a rib extending substantially radially of the shaft and forming part of the bearing means. The projection abuts against the protuberance in such a way that the first braking member normally holds the bearing means and the roller against rotation with the shaft and/or under the influence of the running web (to this end, the projection and the protuberance can overlap each other, as considered in the axial direction of the shaft). The arrangement may be such that the roller or the radially outermost portion of the bearing means abuts against the radially outermost portion of the protuberance when the roller has performed a radial movement exceeding that which is required to engage the coupling means. The projection can constitute an integral part of the first braking member.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
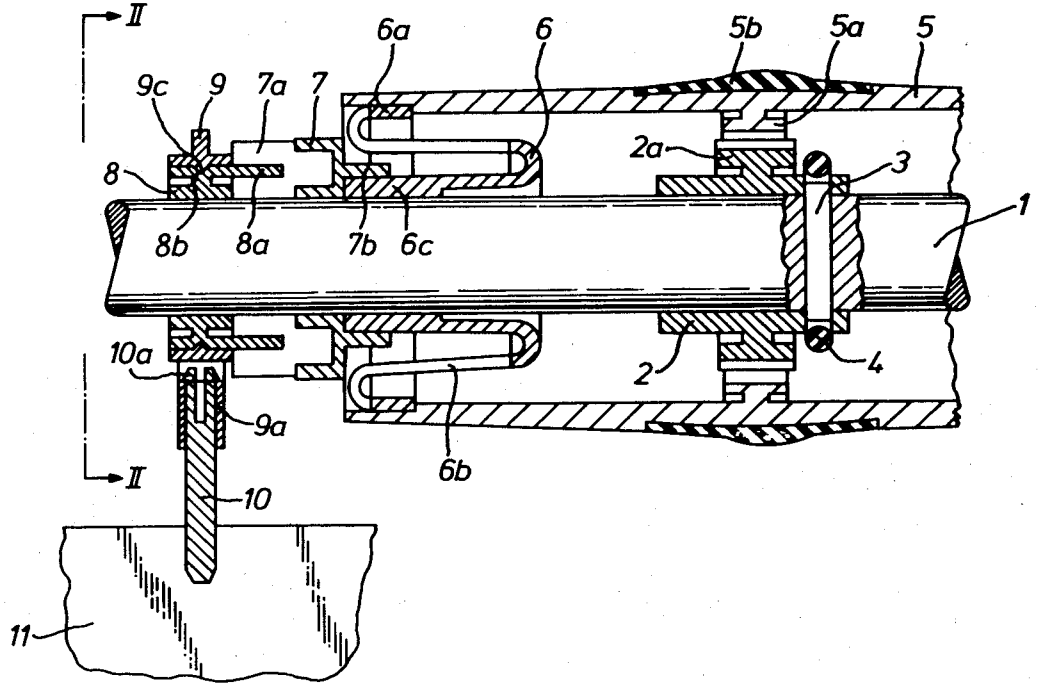
FIG. 1 is a fragmentary substantially vertical sectional view of an apparatus which embodies one form of the invention, the section being taken in the direction of arrows as seen from the line I—I of FIG. 2.
Figure 2:
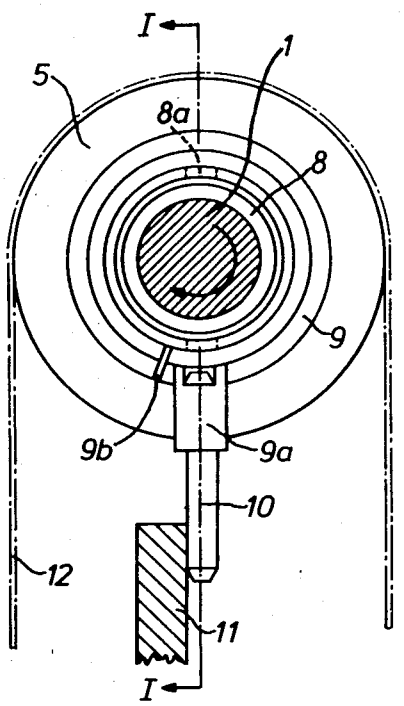
FIG. 2 is a partly end elevational and partly transverse vertical sectional view as seen in the direction of arrows from the line II—II of FIG. 1.

Referring first to FIGS. 1 and 2, there is shown an apparatus for wet treatment of running webs 12 of photographic paper, photographic film or the like. For example, the apparatus can be embodied in a processing laboratory wherein a web of photographic paper must be caused to advance through developing, fixing and rinsing baths before it reaches a drying unit. As shown, for example, in FIG. 3 of the aforementioned commonly owned U.S. Pat. No. 4,134,663 to Laar et al., the web 12 can be drawn off a supply reel and transported along a meandering path through a series of successive liquid-containing chambers each of which has a roller in its bottom part and each of which is located below two rollers so that the web is trained first over one upper roller, thereupon over the roller in the respective chamber and then over the other upper roller before it enters the next chamber. Of course, each chamber can accommodate two or more rollers, and such chamber is then located below a correspondingly increased number of upper rollers if the web is to travel along an undulate path so that it forms two or more loops in each chamber or in selected chambers. This depends on the desired interval of dwell of each increment of the running web in a particular body of liquid and/or on the speed at which the web 12 is advanced (normally pulled) along its path.

Figure 3:
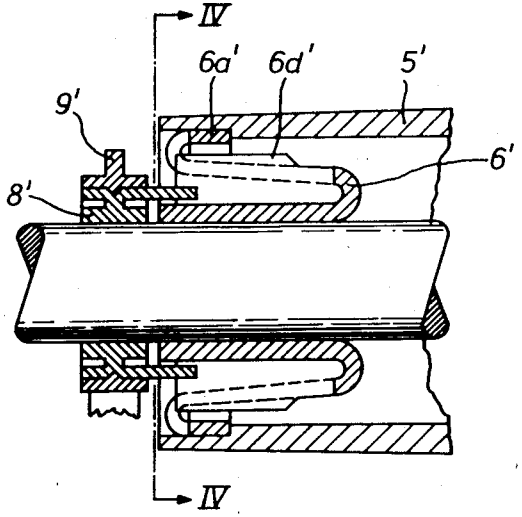
FIG. 3 is a fragmentary substantially vertical sectional view of a modified apparatus as seen in the direction of arrows from the line III—III of FIG. 4.

The improved apparatus comprises a driven shaft 1 (such shaft can be driven by one of the motors 124, 126 shown in the upper portion of FIG. 3 in the patent to Laar et al.) which is coaxially surrounded by an elongated cylindrical sleeve-like roller 5 which is also disposed at a level above the adjacent chamber or chambers of the apparatus, namely at a level above a partition or wall 11 which forms a stationary (permanently installed or detachable) part of the vessel for one or more liquid treating media. The illustrated partition 11 can be replaced with a stationary traverse or with another stationary part which constitutes an element of or is affixed to the housing of the vessel.

As a rule, the surfaces of a web of photographic paper or the like become tacky, especially if the web dwells in a particular liquid medium for an extended interval of time. The problem is aggravated if the web is driven at a very high speed so that requisite periods of dwell of each increment of such rapidly moving web in a particular body of liquid can be ensured only by lengthening the path of movement of the web in each vessel, i.e., by increasing the number of rollers about which the web is trained. Therefore, it is often preferred to drive at least certain rollers of the full complement of rollers in a developing machine or the like at a peripheral speed which exceeds the normal speed of lengthwise movement of the running web. In order to avoid excessive tensioning of the running web, it is desirable and advantageous to provide a coupling or clutch between the continuously driven shaft 1 and the roller 5. In the apparatus of FIGS. 1 and 2, the coupling is constructed and assembled as follows:

That portion of the shaft 1 which is spacedly surrounded by the roller 5 carries a spur gear 2 having an annulus of external teeth 2*a* or a disc with a suitable friction lining (not shown) facing the internal surface of the roller. The hub of the gear 2 has a diametrically extending bore in register with a bore of the shaft 1 and receiving a connecting pin 3 which is reciprocable in the registering bores and is held against axial movement (radially of the shaft 1) by an elastic ring 4 extending into a circumferential groove in the corresponding portion of the external surface of the hub of the gear 2.

The internal surface of the roller 5 is provided with an internal gear 5*a* which surrounds and is normally out of mesh with the spur gear 2 on the shaft 1. The teeth of the internal gear 5*a* can be replaced with a friction lining if the gear 2 is replaced with a friction disc. All that counts is to ensure that, when the roller 5 is caused to move radially of the shaft 1 to a preselected extent, some of the external teeth 2*a* engage the adjacent teeth of the internal gear 5*a* (or the outer lining engages the internal lining) and the shaft 1 begins to transmit torque to the roller 5 by way of the thus engaged coupling.

The roller 5 leaves its normal position of coaxiality with the shaft 1 and causes its internal gear 5*a* to engage the spur gear 2 when the tension of the running web 12 suffices to bring about the required radial movement of the roller. The web 12 is trained over the peripheral surface of the roller 5, and a portion of such peripheral surface is preferably formed by an elastically deformable circumferentially extending bead 5*b* which ensures that the web 12 does not tend to move axially of the shaft 1 and roller 5 when the apparatus is in actual use.

The roller 5 is centered on the shaft 1 by two bearings 6 of which only one is shown in FIGS. 1 and 2. The other bearing is installed in the other end portion of the roller 5 and is preferably identical with (a mirror image of) the illustrated bearing. The bearing 6 which is shown in FIGS. 1 and 2 comprises an at least substantially rigid annulus 6*c* which is readily slidable on and rotatable relative to the shaft 1 and carries six equidistant S-shaped resilient elements 6*b*. The radially outermost portions of the resilient elements 6*b* are installed in a second annulus 6*a* which is disposed in part in a larger-diameter portion of the axial passage of the roller 5. Since the resilient elements 6*b* are relatively long and rather thin, the bearing 6 does not offer a very pronounced resistance to radial movements of the roller 5 from its normal position of coaxiality with the shaft 1. Thus, the roller 5 can yield by moving downwardly, as viewed in FIG. 1 or 2, when the tension of the running web 12 reaches a preselected value so that the resistance of at least one of the two bearings 6 is overcome and the upper portion of the internal gear 5*a* in the roller 5 moves sufficiently close to and into torque-receiving engagement with the continuously driven spur gear 2 on the shaft 1.

The annulus 6*c* of the bearing 6 is surrounded by a ring-shaped insert 7. This insert has a cylindrical sleeve 7*b* which is in rather pronounced frictional engagement with the external surface of the annulus 6*c* so that the parts 6 and 7 rotate or stand still as a unit. That portion of the insert 7 which extends outwardly beyond the respective end portion of the roller 5 has a number of equidistant radially extending ribs or projections 7*a* and such projections define between themselves sockets extending in parallelism with the axis of the shaft 1. Two of the sockets between neighboring ribs 7*a* receive projections 8*a* forming part of a ring-shaped first braking member 8 which rotatably surrounds the shaft 1. The ring 8 is a one-piece body of suitable synthetic plastic material and can be produced in an injection molding or other suitable plastic processing machine. It will be seen that the projections 7*a* and 8*a* cooperate to ensure that the ring 8 shares all angular movements of the roller 5 and bearing 6 or vice versa. The outer diameter of the ring 8 (i.e., the diameter of the preferably cylindrical external surface of this ring) is substantially smaller than (e.g., one-half of) the diameter of the peripheral surface of the roller 5. For example, the diameter of the external surface of the ring 8 can be less than the diameter of the shaft 1 plus the radial dimension of the space between the periphery of the shaft 1 and the internal surface of the roller 5. Otherwise stated, the diameter of the external surface of the ring 8 is preferably less than the radius of the shaft 1 plus the radius of the roller 5.

The external surface of the ring 8 has a circumferentially complete groove 8*b* for a projection or rib 9*c* in the internal surface of a ring-shaped second braking member 9. The projection 9*c* is held in the groove 8*b* by snap action and the external surface of the ring 8 is in rather pronounced frictional engagement with the internal surface of the member 9 (hereinafter called outer ring) so that the rings 8 and 9 are normally held against relative angular movement with a force which is much more pronounced than the friction between the annulus 6*c* of the bearing 6 and the shaft 1. The groove 8*b* and the projection 9*c* cooperate to prevent axial movement of the rings 8 and 9 relative to each other. The ring 9 is a split ring whose radial slot is shown at 9*b*. This split ring is placed around the ring 8 in prestressed condition, i.e., it tends to reduce the diameter of its internal surface whereby such surface bears against the external surface of the ring 8 with requisite friction.

The outer ring 9 is further provided with a radially extending projection including a tubular member 9*a* which is closely or immediately adjacent to the slot 9*b*, and a post or stud 10 having an inner portion removably received in the tubular member 9*a* by snap action and an outer portion which abuts against the partition 11 to thereby invariably prevent rotation of the outer ring 9. The inner portion of the post 10 has resilient prongs which are held by snap action in recesses provided therefor in the deepmost portion of the tubular member 9*a*.

The dimensions of the opening in the ring 9 prior to making of the slot 9*b* are selected in such a way that, after the slot 9*b* is made and the ring 9 is slipped onto the ring 8 so that the projection 9*c* snaps into the groove 8*b*, frictional engagement between the rings 8, 9 suffices to counteract the tendency of the roller 5 to rotate not only under the action of the running web 12 but also due to some friction between the annuli 6*c* of the two bearings 6 and the shaft 1. On the other hand, friction between the rings 8, 9 of the braking device does not suffice to prevent rotation of the roller 5 with the shaft 1 when the tension of the running web 12 reaches the value at which the roller 5 is moved radially against the opposition of one or both bearings 6 in order to move one or more teeth of the internal gear 5*a* into mesh with one or more teeth 2*a* of the spur gear 2 which latter rotates with the shaft 1.

The operation is as follows:

The outer portion of the post 10 abuts against the partition 11 so that the ring 9 is always held against rotation with or relative to the shaft 1. Thus, the outer ring 9 always remains in the angular position which is shown in FIGS. 1 and 2. The inner ring 8 rotates with the roller 5, if and when the roller rotates. Thus, the ring 8 is at a standstill when the coupling including the gears 2 and 5*a* is not engaged, and the ring 8 rotates with the shaft 1 and roller 5 when the coupling transmits torque from the shaft to the roller. At any rate, the fact that some friction invariably exists between the bearings 6 and the continuously driven shaft 1 does not suffice to overcome the friction between the rings 8 and 9 so that the braking device normally holds the roller 5 against rotation except when such rotation of the roller is warranted in view of the tensional stress upon the running web 12. If the roller 5 is set in motion due to rather pronounced friction between the web 12 and the beaded portion 5*b* of the roller while the coupling 2, 5*a* remains disengaged, the rings 8 and 9 perform a highly desirable braking action by preventing acceleration of the roller 5 under the action of friction between shaft 1 and bearing 6. This is conducive to much more satisfactory running of the web, especially of the trailing portion of the web, because the braking device invariably furnishes a braking action. Thus, the roller 5 will not rotate at a peripheral speed exceeding the speed of lengthwise movement of the web.

Figure 4:
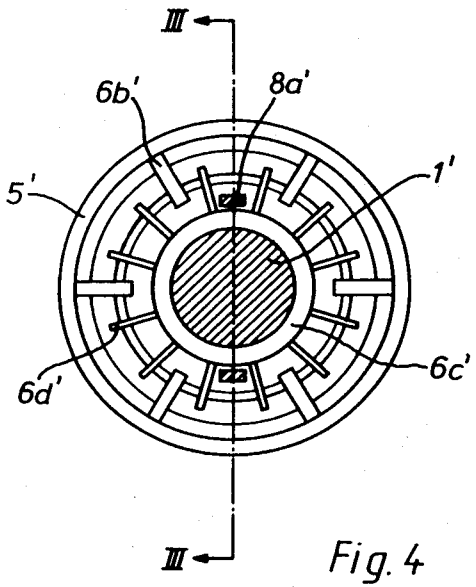
FIG. 4 is a sectional view as seen in the direction of arrows from the line IV—IV of FIG. 3.

FIGS. 3 and 4 show a portion of a modified apparatus wherein the insert 7 of the apparatus of FIGS. 1 and 2 is omitted. All such parts of this second apparatus which are identical with or clearly analogous to the corresponding parts of the first apparatus are denoted by the same reference characters each followed by a prime.

As can be seen in FIG. 4, the annulus 6*c*′ of the illustrated bearing 6′ for the roller 5′ has integral radially disposed protuberances in the form of ribs 6*d*′ (the entire bearing 6′ can be produced in an injection molding machine). The ring 8′ of the braking device has two projections 8*a*′ which extend in substantial parallelism with the axis of the shaft 1′ and into the spaces between two neighboring ribs 6*d*′ so as to ensure that the ring 8′ shares all angular movements of the bearing 6′ (with the exception of minor play with which each of the projections 8*a*′ is received between the neighboring ribs 6*d*′). The dimensions of the ribs 6*d*′, as considered radially of the shaft 1′, are selected in such a way that the outer end faces of some of the ribs are engaged by the internal surface of the roller 5′ when the latter is caused to perform an excessive radial movement, i.e., a movement in excess of that which is necessary to engage the coupling (not shown in FIGS. 3 and 4). In other words, when the S-shaped elastic elements of the bearing 6′ shown in FIGS. 3 and 4 undergo excessive deformation, the annulus 6*a*′ comes into abutment with certain ribs 6*d*′ which thereby prevent further radial shifting of the roller. For all practical purposes, the annulus 6*a*′ can be considered a part of the roller 5′.

Excessive deformation of the bearings 6′ can take place when the band (not shown) which is used to pull the web through the developing machine leaves its rollers (next to the rings 8, 9 or 8′, 9′ of the braking device) and comes into contact with the roller 5 or 5′. In the absence of the aforediscussed radial dimensioning of the ribs 6*d*′, the band could cause permanent deformation of the S-shaped elastic elements of the respective bearings.

The manner in which the rings 8′ and 9′ of the braking device of FIGS. 3 and 4 cooperate with each other and with the illustrated bearing 6′ to normally prevent rotation of the roller 5′ is the same as described in connection with the rings 8, 9 of the braking device shown in FIGS. 1 and 2.

The braking device including the rings 8, 9 or 8′, 9′ is shown as a separate part because, if all of the rollers 5 or 5′ need not be driven, the idler rollers need not be braked. In other words, the braking device can be used in connection with certain rollers but not with the remaining rollers of a particular machine. The making of the braking device including the rings 8, 9 or 8′, 9′ as a separate part renders it possible to connect such braking device with a selected roller 5 or 5′ or to remove the braking device if the respective roller need not be braked. However, if a particular roller is invariably driven so that it must be braked, the ring 8 can be made integral with the annulus 6*c* of the adjacent bearing 6 or the ring 8′ can be made integral with the adjacent annulus 6*c*′ It is then merely necessary to produce the outer ring 9 or 9′ as a separate part.

All parts of the illustrated apparatus (with the exception of shaft 1 or 1′ and elastic ring 4) are or can be made of a suitable synthetic plastic material which should be resistant to the action of liquids that are used for treatment of the web. Furthermore, and since the parts of the apparatus must be manufactured (e.g., injection molded) with a very high degree of precision and certain of these parts must exhibit a predetermined elasticity for a long period of time, it is desirable to select certain types of synthetic plastic materials which are more suitable than the others. Such materials include polyamides.

An important advantage of the improved apparatus and of the improved braking device is that the braking device is not in direct contact with the roller 5 or 5'. Therefore, the braking device cannot cause excessive and/or premature wear upon the roller. Moreover, the braking device is simple, compact and inexpensive. Since the parts of the braking device (with the exception of the radially outwardly extending portion of the outer ring 9 or 9') do not extend outwardly and away from the shaft 1 or 1' as far as the peripheral surface of the roller 5 or 5', a running web (e.g., a web of photographic paper or the like) can be trained over two neighboring rollers with an improved braking device between such rollers whereby the braking device does not interfere with advancement of the web along its path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. In an apparatus for wet treatment of running webs of photographic paper or the like, a driven shaft; a hollow roller normally coaxially surrounding said shaft and having a peripheral surface engageable by a running web; bearing means for radially movably mounting said roller and arranged to offer a predetermined resistance to radial movement relative to said shaft but to yield when the tension of the running web which contacts the peripheral surface of the roller reaches a preselected value; coupling means engageable to transmit torque from said shaft to said roller in response to radial movement of the roller; and means for braking said roller, including a first braking member arranged to share the rotary movements of said roller and having an annular external surface with a diameter smaller than the diameter of said peripheral surface, a second braking member having an internal surface in frictional engagement with said external surface, and means for preventing rotation of said second braking member so that the first braking member rotates with the roller and relative to said second braking member in response to engagement of said coupling means, said first braking member comprising a first ring which is rotatably mounted on said shaft, and said second braking member including an elastic split ring which surrounds said first ring in prestressed condition so that its internal surface bears against the external surface of said first ring, the internal surface of said split ring bearing against the external surface of said first ring due solely to the elasticity of said split ring, and said split ring having a portion which extends substantially radially outwardly from said first ring and constitutes part of said rotation preventing means, said rotation preventing means further including stop means in abutment with said portion of said split ring.

2. The structure of claim 1, wherein said bearing means is rotatably mounted on said shaft and the friction between said bearing means and said shaft is less pronounced than the friction between said braking members.

3. The structure of claim 1, wherein, said braking means further comprises means for connecting said first braking member to said roller, including at least one projection provided on said ring and a socket rotatable with said roller relative to said shaft and receiving said projection.

4. The structure of claim 3, wherein said ring consists of a synthetic plastic material.

5. The structure of claim 3, wherein said roller has an end portion and said socket is disposed in the region of such end portion of said roller.

6. The structure of claim 1, wherein said split ring has a slot and a said radially outwardly extending portion is adjacent to said slot.

7. The structure of claim 1, wherein said split ring consists of synthetic plastic material.

8. The structure of claim 1, wherein said bearing means is rotatably mounted on said shaft and the friction between such bearing means and said shaft is a fraction of the friction between said braking members.

9. The structure of claim 1, further comprising means for holding said braking members against movement relative to each other in the axial direction of said shaft.

10. The structure of claim 9, wherein one of said internal and external surfaces has a groove extending circumferentially of said shaft and said holding means comprises a projection provided on the other of said internal and external surfaces and extending into said groove.

11. The structure of claim 10, wherein said projection is held in said groove by snap action.

12. The structure of claim 1, wherein said rotation preventing means comprises a tubular member provided on and extending radially outwardly of said split ring, a post having a first portion removably received in said tubular member and a second portion extending radially outwardly beyond said tubular member, and stationary stop means abutting the second portion of said post.

13. The structure of claim 12, wherein the first portion of said post is elastic and is held in said tubular member by snap action.

14. The structure of claim 13, wherein the first portion of said post has several prongs.

15. The structure of claim 1, wherein said first ring has at least one projection extending in substantial parallelism with the axis of said shaft and toward said roller, said bearing means being rotatably mounted on said shaft and having at least one protuberance extending substantially radially outwardly of said shaft and adjacent to said projection.

16. The structure of claim 15, wherein said roller is arranged to be restrained by said protuberance in response to radial movement of said roller through a distance exceeding that which is necessary for engagement of said coupling means.

17. The structure of claim 15, wherein said ring consists of synthetic plastic material and said projection is an integral part of said ring.

18. The structure of claim 1, wherein said split ring has an annular peripheral surface coaxial with said external surface and having a diameter smaller than the diameter of the peripheral surface of said roller.

19. The structure of claim 1, wherein said first ring is arranged laterally of said roller.

* * * * *